US005293806A

United States Patent [19]

Gonzalez

[11] Patent Number: 5,293,806

[45] Date of Patent: Mar. 15, 1994

[54] REACTIVE ARMOR

[75] Inventor: Rene G. Gonzalez, Southfield, Mich.

[73] Assignee: The United States of America as represented by the Secretary of the Army, Washington, D.C.

[21] Appl. No.: 988,058

[22] Filed: Dec. 4, 1992

[51] Int. Cl.[5] ..... F41H 5/007

[52] U.S. Cl. ..... 89/36.03; 89/36.17; 109/81

[58] Field of Search ..... 89/36.03, 36.17; 109/81

[56] References Cited

U.S. PATENT DOCUMENTS 4,867,077 9/1989 Marlow et al. ..... 89/36.17

5,206,451 4/1993 Bocker ..... 89/36.17

FOREIGN PATENT DOCUMENTS 2636595 2/1978 Fed. Rep. of Germany ..... 89/36.17

*Primary Examiner*—Stephen C. Bentley

*Attorney, Agent, or Firm*—Peter A. Taucher; Gail S. Soderling

[57] ABSTRACT

A reactive armor structure is disclosed for protecting a vehicle. A housing encloses a chamber attached to the vehicle. A reactive armor sandwich with two rigid plates is mounted transversely across the chamber. The reactive armor sandwich is designed so the explosion of an explosive layer in the reactive armor sandwich causes the rigid plates to rotate so as to strike the penetrator.

5 Claims, 2 Drawing Sheets

REACTIVE ARMOR

GOVERNMENT INTEREST

The invention described herein may be manufactured, used and licensed by or for the Government for governmental purposes without payment to me of any royalty.

BACKGROUND OF THE INVENTION

1. Field of the Invention

In one aspect this invention relates to a reactive armor system useful with armored vehicles. In yet a further aspect, this invention relates to a reactive armor system with an improved defeating mechanism used in the armor to defeat an antiarmor round during incursion.

2. Prior Art

In order to survive, combat vehicles have traditionally employed heavy metallic armor. Such combat vehicles have faced the prospect of increasingly lethal and sophisticated threats. In response it was conventional to provide ever increasing thicker and stronger armor to protect against the ever improving rounds. However, with solid armor increasing protection always has the associated problem of increasing weight. The invention of new types of antiarmor rounds with shaped charges or high density, tough material penetrators, has made the weight gain caused by providing thick enough solid armor prohibitive. In fact some of the modern charges are so efficient that a passive armor is not practical.

To counter act the shaped charges and improved penetrators, a new means of protection was necessary. The solution was to develop a reactive armor which reacts to the threat and disrupts the penetrating threat when it encounters the armor.

Reactive armor provides a solution and an efficient means of protection from modern rounds. Reactive armor is particularly effective considering the degree of protection offered as a function of armor weight.

One example of an armor construction designed to disrupt the thorn of a shaped charge is disclosed in U.S. Pat. No. 4,368,660. This patent discloses an armor structure with an inner and outer wrapper surrounding an explosive core. When a shaped charge strikes the armor, the explosive charge will cause the wrapper layers to move away from each other in such a manner that additional wrapper material is brought into engagement with the penetrating thorn. The dense wrapper material continuously contacting the thorn, degrades the thorn and protects the underlying armor.

The reactive armor concept has been further refined by mounting the reactive armor above the base armor to provide better protection. Examples of mounting systems for holding reactive panels in a spaced relationship to underlying armor are shown in U.S. Pat. No. 4,867,077 and U.S. Pat. No. 4,741,244. U.S. Pat. No. 4,867,077 discloses an explosive package with explosive material layered between resilient layers of material and further enclosed within the armor material. The package is then mounted on projections attached to the armor so the reactive armor packages are maintained spaced apart from the base armor.

A second mounting structure is disclosed in U.S. Pat. No. 4,741,244 where cover members are attached to the surface to be protected with the reactive panels and a reactive panel is mounted on the interior of the cover which holds the reactive panel at a distance from the base armor.

A third reactive armor structure is disclosed in U.S. Pat. No. 4,881,448. This patent discloses a structure with metal sheets as the outer layer of a reactive armor structure the core being an incompressible material which causes the outer layers to push outwardly away from each other when hit by an explosive charge.

Although the above description and patents focus on the thorn formed by shaped charge rounds and penetrators, all of the reactive armor plates function by the explosive material causing the metallic outer plates to separate away from each other, the same action will cause the plates to separate when the armor is struck by a solid penetrator. The penetrator will normally strike the armor obliquely and the separation of the plates due to the deformation caused by the explosive will cause the separating plates to strike the penetrator's sides and break up the penetrator; the resulting penetrator fragments are trapped in the conventional armor located behind the reactive plate.

However, modern penetrators are being made of very dense and tough materials requiring over increasing amounts of energy to break up the penetrators. Further the modern penetrators have a relative high length to diameter ratio which further compounds the problem. As the amount of energy required to defeat the threat increases, the amount of reactive energy required in the plates is increased. As a result, the plates themselves become hazardous to persons near by. In fact the greater energy plates can fragment and portions of the plate fly considerable distances from the vehicle when activated. Since infantry personnel are normally close to the armored vehicles for protection, there is greater hazard to them from the better armor.

A second problem with conventional reactive armor is its increasing effectiveness the closer the penetration angle approaches orthogonality. At a ninety degree incursion, conventional reactive armor causes little or no penetrator dislocation. Yet a further problem with conventional armor is that it is often dependent on the ability of the metal in the reactive structure to deform under the force of an explosion caused by penetrator impact. This means ceramics and other nonductile materials are not useful in such reactive armor structures.

The present invention is designed to ameliorate the danger and the problems of the prior art structures. Further the present invention provides a structure which allows the use of nonductile materials as part of the reactive armor sandwich. It is also an object of this invention to provide a reactive armor structure which is highly effective against orthogonally incident penetrators.

BRIEF SUMMARY OF THE INVENTION

The present invention is a reactive armor structure for protecting a military vehicle having base armor mounted to the vehicle to be protected from a projectile. The structure includes means to mount a reactive armor member spaced from a base armor structure attached to a vehicle, so that reactive armor member will rotate when activated by a threat.

DETAILED DESCRIPTION OF PREFERRED EMBODIMENTS

Figure 1:
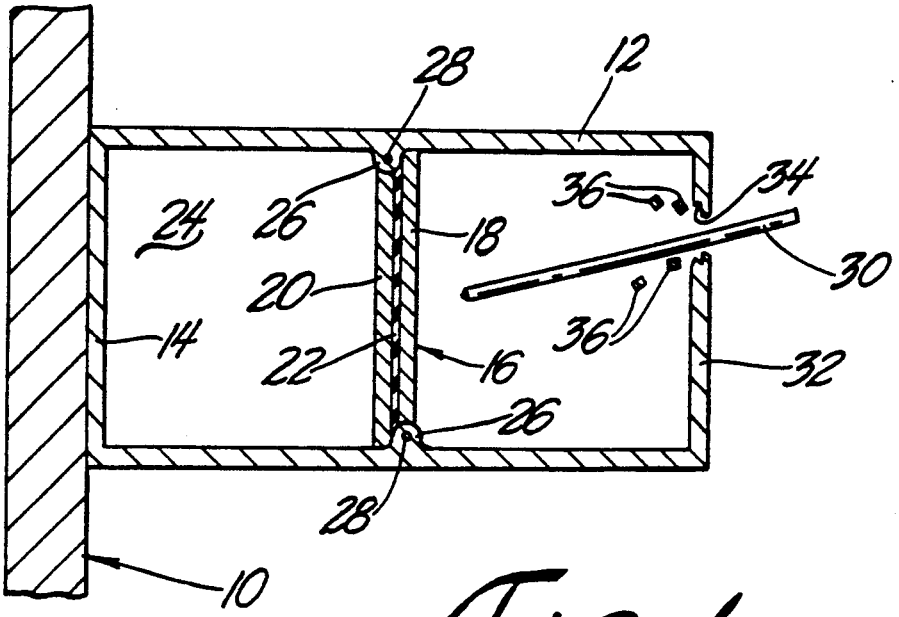
FIG. 1 is a side view in section of one embodiment of this invention with an impinging projectile.
Figure 2:
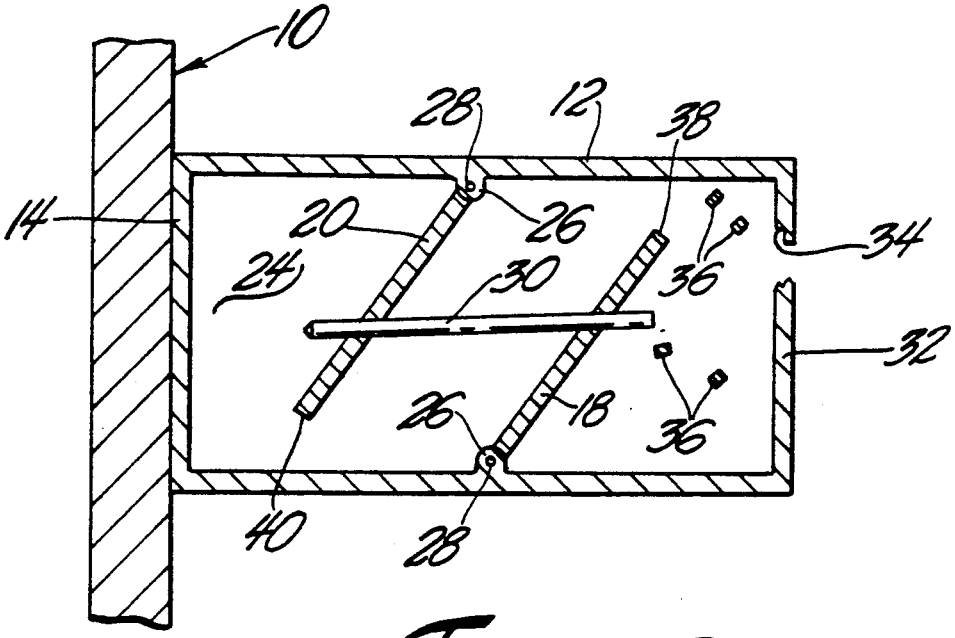
FIG. 2 is a side view in section of the FIG. 1 structure after the projectile has activated the reactive plate.

Referring to the accompanying drawing where like numerals refer to like parts, and initially to FIGS. 1 and 2, a portion of base armor 10 is shown. The vehicle and the entire armor package are not detailed in full since their structure is well known in the art and their construction does not constitute part of the present invention. A full description is omitted in the interest in brevity.

A housing 12 has one side 14 rigidly attached to the base armor 10. The attachment could be by welding, fasteners or other fabrication techniques the important thing being the housing is adequately attached and will remain attached to the vehicle during actual battle field conditions. In addition to welding it is an accepted technique to mount reactive armor modules on studs extending outwardly from base armor mounted on a vehicle chassis. Of course the mounting technique chosen must not degrade the base armor characteristics which would decrease the armor effectiveness. The housing 12 will generally be formed of a metallic armor material although other armor materials such as ceramics or ballistic composite materials are being developed and could prove useful in the practice of this invention.

A reactive armor sandwich designated generally 16 comprised of two rigid plates 18, 20 with an explosive layer 22 sandwiched between the rigid plates is mounted transversely across a chamber 24 enclosed by the housing. As shown in FIGS. 1 and 2, the rigid plates 18, 20 are pivotally mounted at one end to a side of the housing 12. The other end of each rigid plate is free to swing away from the other plate unimpeded when the explosive layer 22 is activated. In FIGS. 1 and 2, the plates are shown pivotally mounted to the housing plate with one end pinned to a boss 26 using a shaft 28 which provides a mounting means for the rigid plates allowing rotation. As shown the rigid plates are free to rotate through an arc of up to ninety degrees in opposite directions. In the drawing, the top of plate 18 can move clockwise to the right with the bottom rotating about its pin 26 while plate 20 has its top mounted in its boss 26 and is constrained by pin 28 with the bottom free to rotate clockwise to the left in the drawing. The mounting boss of one plate obstructs the rotation of the other plate ensuring that the plates rotate in opposite directions.

In FIG. 1 a projectile 30, depicted as a highly density long rod penetrator, is shown having just breached an outer wall 32 of the housing 12 formed a hole 34 and armor fragments 36. The number of fragments and size of the hole formed will depend on the strength of the housing material and its friability. Generally a portion of the outer wall 32 will fracture becoming spall or shrapnel type material which can be stopped easily by the base armor 10. In FIG. 1, the penetrator has not contacted the reactive sandwich 6 so it is intact and unactivated. The rigid plates 18, 20 are located transversely across the interior chamber 24 of housing 12 so the penetrator 30 must contact the reactive sandwich 16 as it proceeds towards the vehicle. The rigid plates 18, 20 are held in their transverse position juxtaposed the explosive layer 22. The means for making suitable reactive sandwiches are known in the art of armor production and will not be discussed in detail. It is a know technique to use the adhesive characteristics of the explosive layer as a binder to hold the reactive sandwich together.

In FIG. 2, the projectile 30 has contacted and penetrated the reactive sandwich 16 causing the explosive layer 22 to explode violently. The plates 18 and 20 have begun to rotate about their respective mounting pins 28 with the free end 38, shown as the upper end of the first plate 18 moving to the right as shown in the drawing and the free end 40 of the second plate 20, having its lower portion, moving to the left as shown in the drawing. The sides of projectile 30 will be simultaneously contacted by the edges of the apertures it has punched in both plates creating a twisting moment on the projectile. It is expected that the projectile 30 will have up to four separate contact points with the plates 18, 20 each plate having a contact on each side of the projectile to increase the degree of rotation applied to the projectile. The resulting twisting moment will cause the projectile 30 to yaw markedly thereby disrupting its path and decreasing its potential of penetration. The projectile as shown in FIG. 2 has had its path markedly changed from its entry trajectory. In addition the torsional moment placed on the projectile 30 by the rotating plates may and in many cases will cause the projectile to break into fragments which lack the penetrating power of an intact penetrator so they can be easily attentuated by the base armor.

In the embodiment of FIGS. 1 and 2, the rotation of the rigid plates 18, 20 is caused by the combination of the explosive force of layer 22 and the mounting of one end with the other end free to move. The materials need not deform at the aperture formed in the plates as required by prior art structures. Also, since the amount of plate rotation is not limited by the plates plasticity, the plate can move through a greater angular rotation to cause a greater amount of plate to contact the projectile for a longer period. This can increase the destructive potential of the reactive armor.

This example has used two plates which form a reactive sandwich with the explosive. However, a single plate could also function as an effective reaction device.

Figure 3:
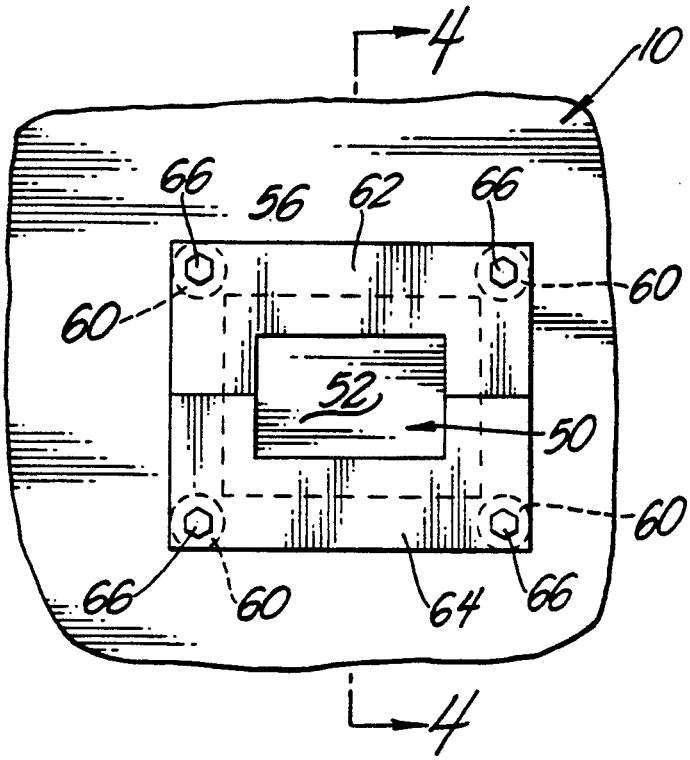
FIG. 3 is a front view of a second embodiment of this invention with a reactive plate.
Figure 4:
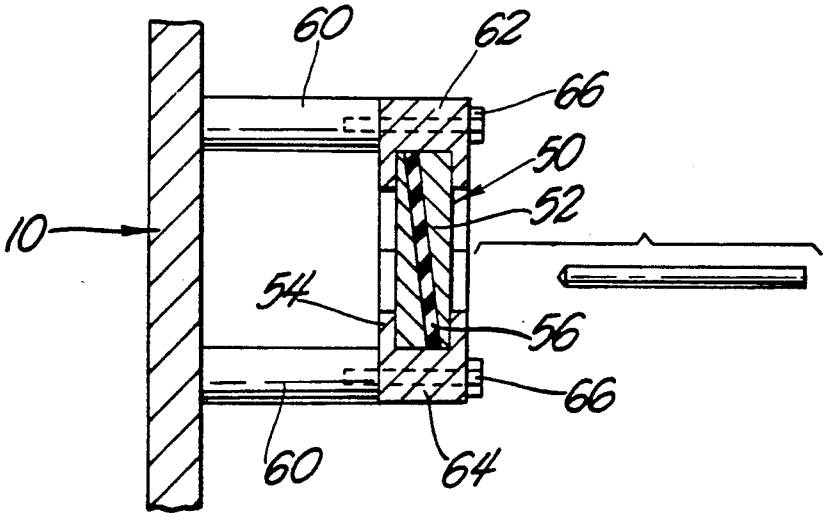
FIG. 4 is a side view in section of FIG. 3 taken along the line 4—4 of FIG. 3 with a projectile nearing the reactive plate.

FIGS. 3 and 4 show a different configuration of reactive armor according to this invention. These Figures show a different mounting mechanism and a different reactive plate structure. As shown in FIGS. 1 and 2, only a portion of vehicle base armor 10 is shown. In this embodiment, the mounting means for holding a reactive armor sandwich comprises a picture frame type mounting having four upright posts 60 attached on one end to the base armor structure 10. The reactive sandwich 50 of this embodiment is enclosed around its edges by two frame members 62, 64 formed with a U-shaped channel designed to surround the edges of the reactive sandwich 50. The frame members have apertures at the corners so that the frame members and reactive sandwich combination can be mounted to the posts. As shown threaded fasteners 66, such as a ordinary hex head bolts are used to attach the framed sandwich to the posts 60. This structure holds the sandwich 50 in a spaced relationship to the base armor 10. In addition the use of posts and framed reactive plates allows easy construction and simple replacement of reactive packages when the package has been activated or an improved reactive plate is developed.

In this embodiment, the reactive armor sandwich 50 has a different construction than that shown in FIGS. 1 and 2. This reactive sandwich is comprised of two shaped rigid plates 52, 54 consolidated by an explosive layer 56. The rigid plates 52, 54 have a nonuniform mass distribution with one side of the plate having a greater thickness and thereby greater mass than the other. The plates are shown in cross section as trapezoidal in configuration although other nonuniform mass distributions could be used. The reactive sandwich 50 has two nonuniform plates joined so their centers of mass are complimentary with one center of mass located above the midline of the housing and the other plate's center of mass located below the center line. The plates 52, 54 can move independently and rotate unimpeded when the explosive layer 56 is activated.

In FIG. 4 as in FIG. 1 a projectile 30, depicted as a high density long rod penetrator, is shown nearing the reactive sandwich 50 so it is intact and unactivated.

As the projectile 30 continues its flight, it would come into contact with the sandwich 50 penetrating the reactive sandwich and causing the explosive layer 56 to explode violently. The plates 52, 54 because of their nonuniform mass distribution will react to the relatively uniform explosive force on their surfaces in contact with the explosive by rotating, the heavier end of the plates being accelerated relatively slower than the light end of the plate as shown in FIG. 4. The projective will be simultaneously contacted by the edges of the apertures it has punched in the plates 52, 54 creating a twisting moment on the projectile. The resulting twisting moment will cause the projectile to yaw markedly thereby disrupting its path and decreasing its forward energy with the same results set forth above.

This embodiment shows an alternate means to create a rotating or tumbling plate using reactive armor techniques. It also shows that other mounting means can be used to hold the reactive armor to the base armor.

As shown there is one reactive sandwich used. The yawing effects of the rotating or tumbling plates is cumulative and it would be possible to have a plurality of plates mounted in the housing or a spaced frame structure to provide a multiplicative effect to the yawing action.

FIGS. 1 and 2 show the plates as being hinged on opposite sides of the housing. However they could be hinged on the same edge. The hinge is shown as pivoting about a pin but it could be a plastic hinge member or the plates could be mounted so one end of the plates is constrained slightly during the projectile incursion.

A variety of explosive materials have proved suitable for use as the explosive layer of the reactive sandwich. Examples of suitable explosives include hexogen, octogen, nitropenta, tentral and mixtures of these compounds. One example of a suitable mixture is 60% by weight hexogen, 39% by weight TNT, and 1% by weight wax. Another suitable mixture is 90% by weight nitropenta and 10% by weight wax. Additional explosive compounds are constantly being developed and those explosives with similar shock wave propagation and detonation velocity characteristics should perform in a suitable manner in the practice of this invention.

The reactive structures are shown as using an explosive layer detonated by the projectile impact. Other reactive structures would be useful in the practice of this invention. The source of energy for initiating plate motion could be mechanically stored energy of some form of electromagnetic force. Mechanical storage has the advantage of simplicity and the electromagnetic forces can be designed to act in concert with sensing devices to initiate action as the threat is approaching.

The solid plates described above have proved effective in defeating the incursion of penetrators and are particularly effective against incursions which are close to orthogonal in nature. Where shaped charges are the most likely threat it is contemplated that multiple layers of reactive armor would be used with the outermost layer being of a conventional reactive laminate design to begin destruction of any thorn formed followed by the tumbling plates destroying any remaining threat.

The rigid plates of this invention can be formed of normal metallic armor materials. Examples include alloys of iron, aluminum and titanium all of which are known in the art. Because the structure of the present invention causes the rigid plates to rotate into the projectile, the action of the reactive armor is not dependent on the plate material deforming. Therefore the plates can be formed of nonmetallic and even nondeformable materials. Examples of suitable nonmetallic materials would include layers of ballistic fabrics i.e. polyaramid, fiberglass, or nylon and ceramics materials i.e. alumina, silicon carbide, or boron nitride. The ballistic fabrics and ceramic materials can be used singly or in combination with each other or metals as composite structures to form the rigid plates.

Various modifications and alterations will become apparent to those skilled in the art without departing from the scope and spirit of this invention and it is understood that this invention is not limited to the illustrative embodiments set forth above.

What is claimed is:

1. A reactive armor structure for protecting a military vehicle having a base armor mounted on the vehicle to be protected from a projective comprising, a housing enclosing a chamber, the housing having one side rigidly attached to the outer surface of the base armor, the rigid attachment serving to permanently mount the housing on the base armor; a reactive armor sandwich comprising an explosive layer mounted between two nonreactive rigid plates, the sandwich being mounted transversely across the chamber of the housing, the reactive armor sandwich being mounted so that when the explosive portion of the reactive armor sandwich is activated, the rigid plates will cause both of the plates to rotate each plate rotating separately as a unit the plates rotating in opposite directions and striking the penetrator.

2. The structure of claim 1 wherein the reactive sandwich has a first rigid plate having one end rotatably attached to one side of the housing and the opposite end of the rigid plate is free to rotate when the explosive layer is activated, and having a second rigid plate rotatably attached to a different plate of the housing with the opposite end of the second plate being free to rotate when activated by the explosive layer.

3. The armor structure of claim 1 where a first plate is formed with a nonuniform mass distribution so that the activation of the explosive layer causes a rotation motion of the first plate and a second plate formed with a nonuniform mass distribution so that the activation of the explosive layer causes a rotating motion of the second plate.

4. The Armor structure of claim 1 where the rigid plates are made from ballistic fibrous material consolidated by a thermosetting resin.

5. A reactive armor structure for protecting a military vehicle having a base armor mounted on the vehicle to be protected from a projective comprising:

a mounting frame attached to the base armor and extending outward from the base armor;

at least one solid layer mounted in the mounting frame, the solid layer being maintained in a spaced relationship to the base armor to be protected, the solid layer being formed as a reactive armor sandwich with a first plate and a second plate enclosing an intermediate reactive layer therebetween the first plate being formed with a nonuniform mass distribution so activation of the reactive layer causes a rotating motion of the first plate and the second plate being formed with a nonuniform mass distribution so that activation of the reactive layer causes a rotating motion of the second plate the rotating layers striking the penetrator to disrupt its path.

* * * * *